US008939442B2

(12) United States Patent
Wang

(10) Patent No.: US 8,939,442 B2
(45) Date of Patent: Jan. 27, 2015

(54) DOUBLE CLAMP VISE

(76) Inventor: Wen-Feng Wang, Miaoli County (TW)

( * ) Notice: Subject to any disclaimer, the term of this patent is extended or adjusted under 35 U.S.C. 154(b) by 340 days.

(21) Appl. No.: 13/555,191

(22) Filed: Jul. 23, 2012

(65) Prior Publication Data

US 2014/0021667 A1 Jan. 23, 2014

(51) Int. Cl.
*B25B 1/10* (2006.01)
*B25B 1/00* (2006.01)

(52) U.S. Cl.
CPC ..... *B25B 1/103* (2013.01)
USPC ..... 269/242; 269/153

(58) Field of Classification Search
CPC .... B25B 1/2478; B25B 1/103; B25B 1/2405; B25B 1/125
USPC ..... 269/242, 153, 154, 165, 172, 188, 189, 269/216, 240, 244, 246
See application file for complete search history.

(56) References Cited

U.S. PATENT DOCUMENTS 4,529,183 A * 7/1985 Krason et al. ..... 269/43
4,685,663 A * 8/1987 Jorgensen ..... 269/244
4,899,999 A * 2/1990 Arnold ..... 269/240
4,934,674 A * 6/1990 Bernstein ..... 269/43
5,022,636 A * 6/1991 Swann ..... 269/43
5,098,073 A * 3/1992 Lenz ..... 269/43
5,242,159 A * 9/1993 Bernstein ..... 269/32
5,351,943 A * 10/1994 Milz ..... 269/246
5,374,040 A * 12/1994 Lin ..... 269/43
5,458,321 A * 10/1995 Durfee, Jr. ..... 269/43
5,505,437 A * 4/1996 Durfee, Jr. ..... 269/43
5,623,757 A * 4/1997 Durfee, Jr. ..... 29/559
5,634,253 A * 6/1997 Swann ..... 29/281.1
5,649,694 A * 7/1997 Buck ..... 269/43
5,702,096 A * 12/1997 Buck ..... 269/43
5,720,476 A * 2/1998 Swann et al. ..... 269/136
5,806,841 A * 9/1998 Hebener ..... 269/20
5,893,551 A * 4/1999 Cousins et al. ..... 269/43
5,921,534 A * 7/1999 Swann et al. ..... 269/136
5,984,290 A * 11/1999 Durfee, Jr. ..... 269/43
6,012,712 A * 1/2000 Bernstein ..... 269/43
6,017,026 A * 1/2000 Durfee, Jr. ..... 269/271
6,036,184 A * 3/2000 Wurthele ..... 269/43
6,079,704 A * 6/2000 Buck ..... 269/242
6,170,814 B1 * 1/2001 Swann et al. ..... 269/329
6,206,354 B1 * 3/2001 Lin ..... 269/43
6,244,580 B1 * 6/2001 Durfee, Jr. ..... 269/43
6,250,620 B1 * 6/2001 Durfee, Jr. ..... 269/43
6,409,161 B1 * 6/2002 Wolff et al. ..... 269/43
6,585,247 B2 * 7/2003 Mattox et al. ..... 269/244
6,598,867 B2 * 7/2003 Martinez ..... 269/43
7,163,201 B2 * 1/2007 Bernstein ..... 269/32

(Continued)

*Primary Examiner* — Lee D Wilson
*Assistant Examiner* — Jamal Daniel

(57) ABSTRACT

The vise includes a seat body having two movable jaws separately with two inner threads, a fixed jaw and a rail. A screwing rod has a rear portion and a front portion whose diameter is less than the rear portion. A first outer thread is formed on the rear portion. A step is formed between the front portion and the rear portion. A screwing tube telescopically and unrotatably sheathes the front portion of the screwing rod and has a second outer thread. The two movable jaws are separately engaged with the screwing tube and screwing rod by screwing the outer threads and the inner threads. A spiral direction of the first outer thread is contrary to the second outer thread. A main spring is nipped between the screwing rod and screwing tube. A crank is axially connected to the front portion of the screwing rod for rotating the screwing rod.

7 Claims, 6 Drawing Sheets

(56) References Cited

U.S. PATENT DOCUMENTS

| | | | | |
|---|---|---|---|---|
| 8,256,753 | B2 * | 9/2012 | Teo | 269/43 |
| 8,408,527 | B2 * | 4/2013 | Klingenberg et al. | 269/154 |
| 8,690,138 | B2 * | 4/2014 | Lin et al. | 269/240 |
| 2002/0005609 | A1 * | 1/2002 | Mattox et al. | 269/244 |
| 2003/0071402 | A1 * | 4/2003 | Martinez | 269/43 |
| 2004/0195752 | A1 * | 10/2004 | Migliori | 269/244 |
| 2006/0049566 | A1 * | 3/2006 | Bernstein | 269/43 |
| 2008/0157454 | A1 * | 7/2008 | Huang | 269/216 |
| 2012/0169000 | A1 * | 7/2012 | Lin et al. | 269/216 |
| 2014/0021667 | A1 * | 1/2014 | Wang, Wen-Feng | 269/20 |

* cited by examiner

DOUBLE CLAMP VISE

BACKGROUND OF THE INVENTION

1. Technical Field

The present invention relates to vises, particularly to double clamp vises.

2. Related Art

A vise or vice is a mechanical screw apparatus used for holding or clamping a work piece to allow work to be performed on it with tools such as saws, planes, drills, mills, screwdrivers, sandpaper, etc. Vises usually have one fixed jaw and another, parallel, jaw which is moved towards or away from the fixed jaw by the screw. A double clamp vise has two movable jaws oppositely beside a fixed jaw. Such a double clamp vise can hold two work pieces at the same time. Thus its working efficiency is double higher than others.

However, a double clamp vise still has a restriction in use: the two clamps cannot hold two work pieces with different thickness. This really causes a problem.

SUMMARY OF THE INVENTION

An object of the invention is to provide a double clamp vise which can hold two work pieces with different thickness.

To accomplish the above object, the vise of the invention includes a seat body having two movable jaws separately with two inner threads, a fixed jaw and a rail. A screwing rod has a rear portion and a front portion whose diameter is less than the rear portion. A first outer thread is formed on the rear portion. A step is formed between the front portion and the rear portion. A screwing tube telescopically and unrotatably sheathes the front portion of the screwing rod and has a second outer thread. The two movable jaws are separately engaged with the screwing tube and screwing rod by screwing the outer threads and the inner threads. A spiral direction of the first outer thread is contrary to the second outer thread. A main spring is nipped between the screwing rod and screwing tube. A crank is axially connected to the front portion of the screwing rod for rotating the screwing rod.

DETAILED DESCRIPTION OF THE INVENTION

Figure 1:
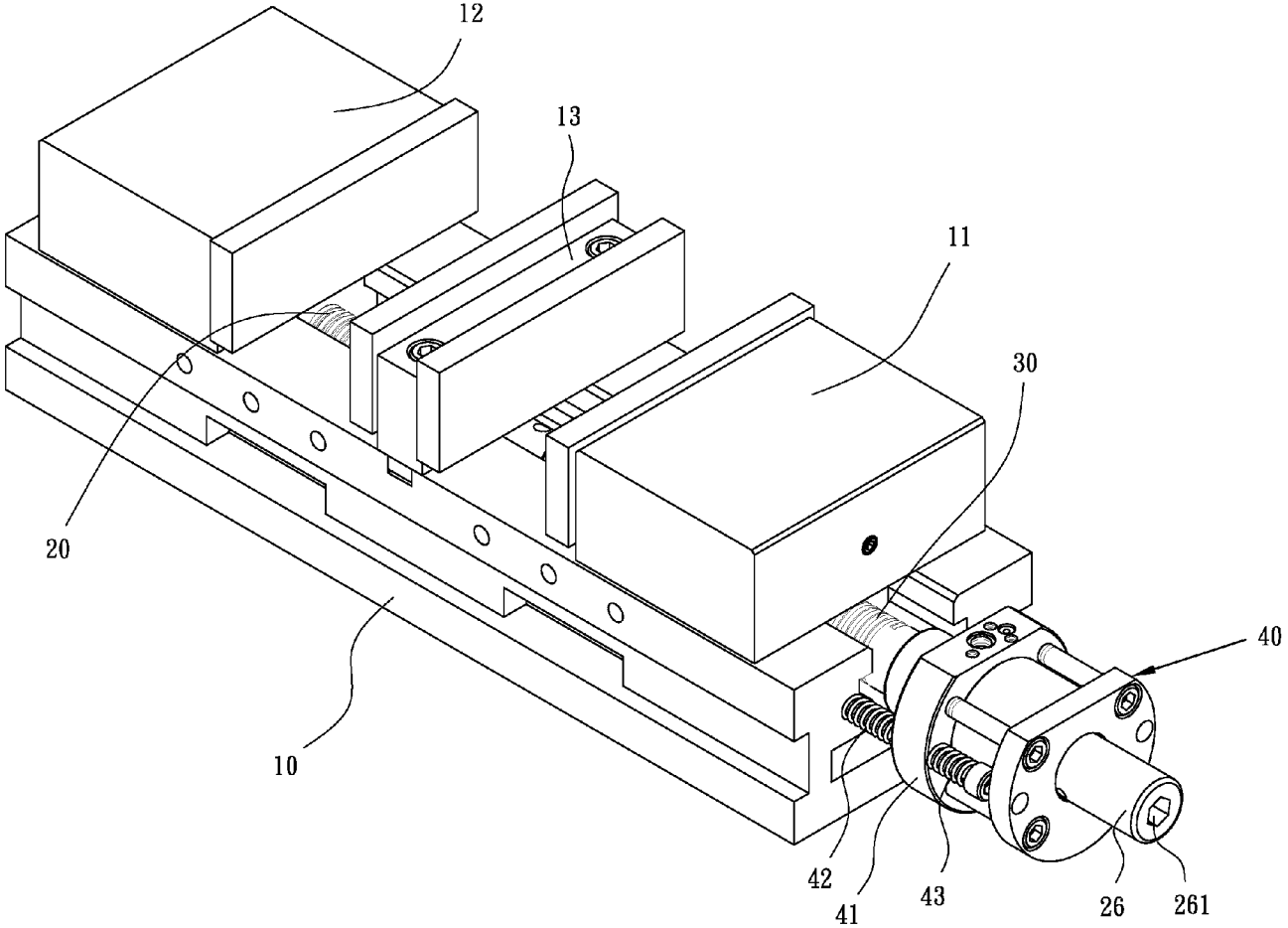
FIG. 1 is a perspective view of the invention.
Figure 2:
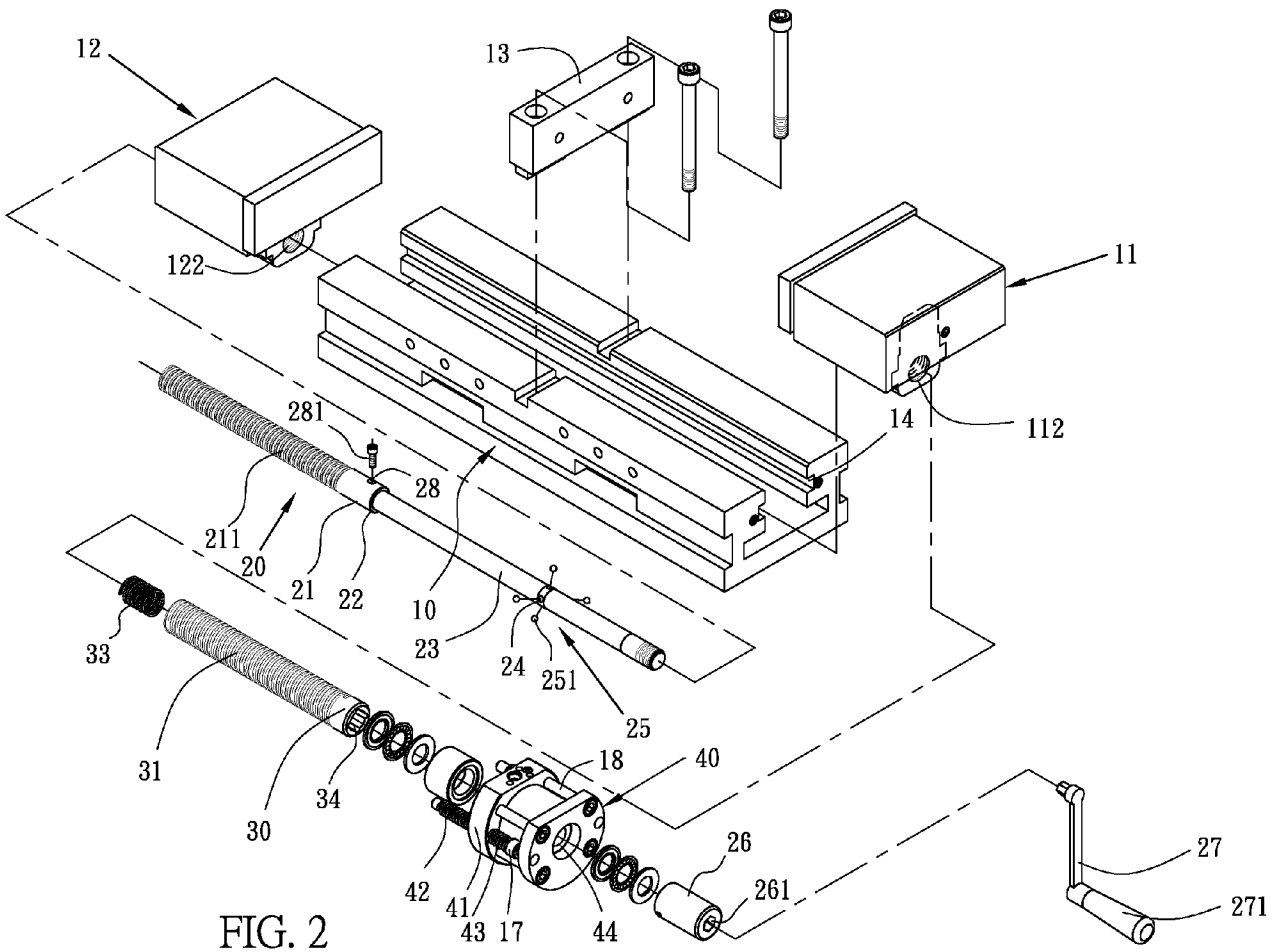
FIG. 2 is an exploded view of the invention.

Please refer to FIGS. 1 and 2. The double clamp vise of the invention includes a seat body 10, a screwing rod 20, a screwing tube 30, a main spring 33, a crank 27 and a power assist module 40.

The seat body 10 has a rear movable jaw 12, a front movable jaw 11, a fixed jaw 13 between the two movable jaws 11, 12, and a rail 14 for being slidably engaged by the two movable jaws 11, 12. The rear movable jaw 12 and front movable jaw 12 are provided with a first inner thread 122 and a second inner thread 112, respectively.

The screwing rod 20 is composed of a rear portion 20 and a front portion 23. A diameter of the rear portion 21 is greater than that of the front portion 23. A first outer thread 211 is formed on the rear portion 21. A step 22 is formed between the front portion 21 and the rear portion 23. The rear movable jaw 12 is engaged with the screwing rod 20 by screwing the first outer thread 211 and the first inner thread 122. In other words, the rear portion 21 is screwed in the rear movable jaw 12.

The screwing tube 30 telescopically and unrotatably sheathes the front portion 23 of the screwing rod 20 and is formed with a second outer thread 31. An anti-rotation mechanism 25 is arranged between the screwing tube 30 and the front portion 23 of the screwing rod 20. Thus, the screwing tube 30 can be axially slid on but cannot be rotate against the front portion 23 of the screwing rod 20. The front movable jaw 11 is engaged with the screwing tube 30 by screwing the second outer thread 31 and the second inner thread 112. In other words, the screwing tube 30 is screwed in the front movable jaw 11. Furthermore, a spiral direction of the first outer thread 211 is contrary to that of the second outer thread 31.

Figure 3:
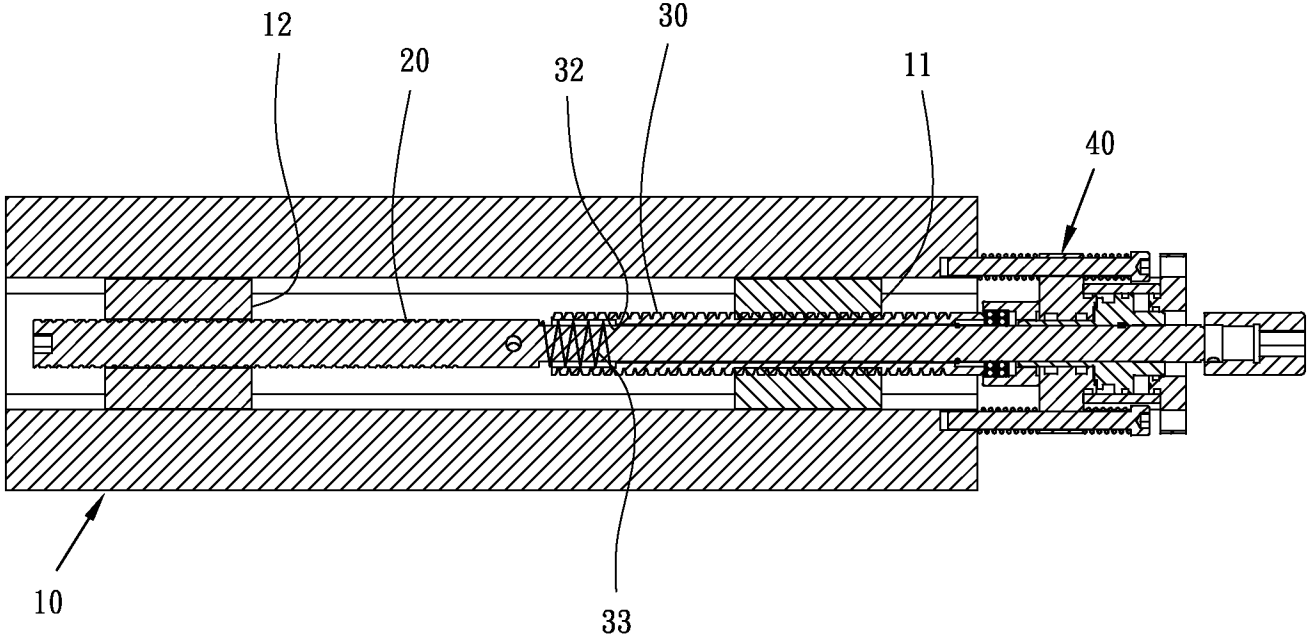
FIG. 3 is a longitudinal sectional view of the invention.

Please further refer to FIG. 3. A recess 32 is formed in a rear end of the screwing tube 30, where the rear end refers to the end nearing the step 22. A main spring 33 is put around the front portion 23 of the screwing rod 20 and nipped between the step 22 and a vertical edge of the recess 32 for proving an extension force.

A crank 27 with a handle 271 is axially connected to the front portion 23 of the screwing rod 20 for rotating the screwing rod 20. Preferably, a sleeve 26 with a through hole 261 is disposed between the crank 27 and the screwing rod 20.

Figure 6:
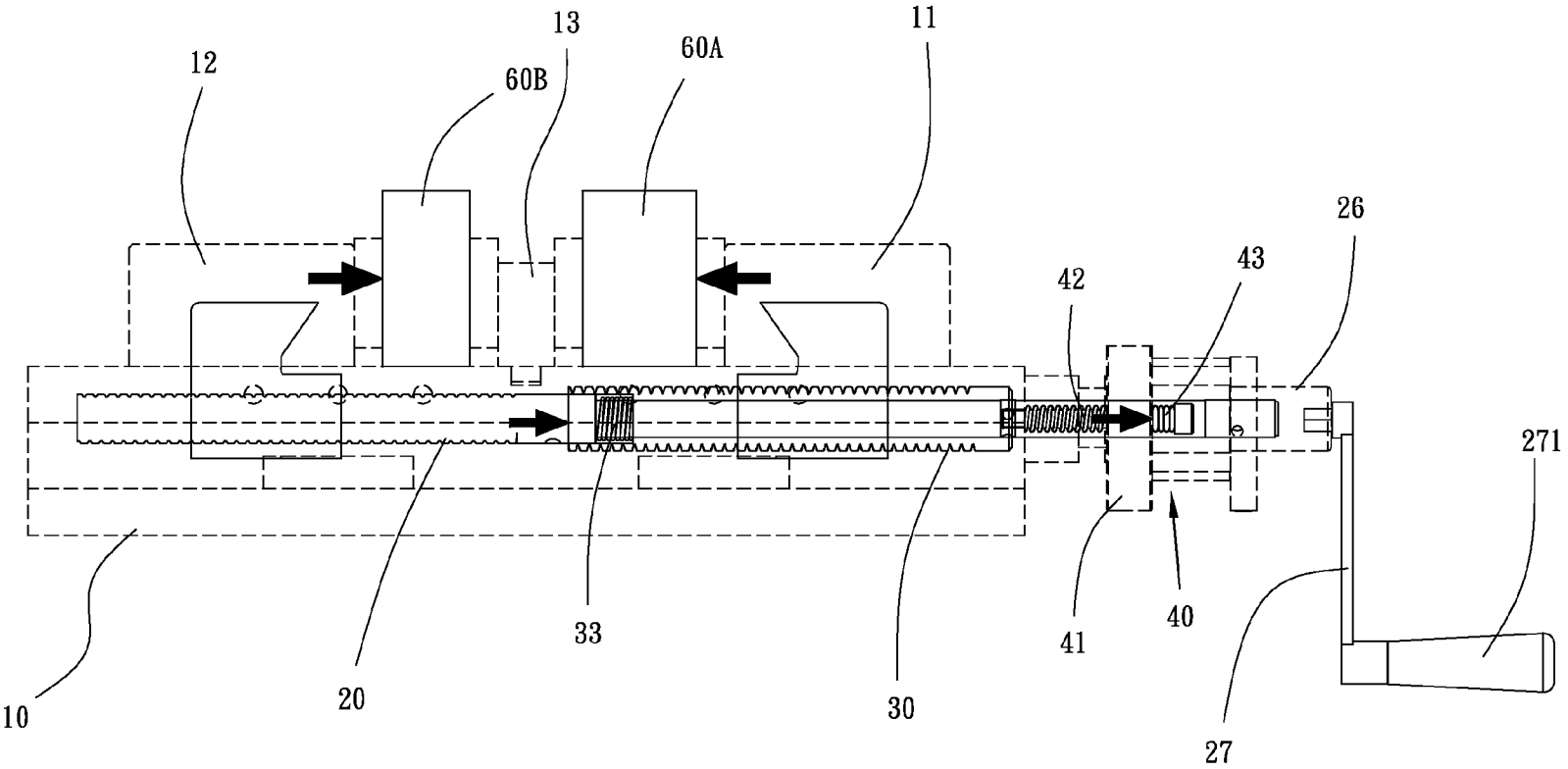
FIG. 6 is another schematic view showing the two clamps clamp two work pieces with different thickness.

A power assist module 40 is flexibly fixed on an end of the seat body 10. The power assist module 40 has a base 41. The base 41 is penetrated through by two fixing rods 17, 18, each of which is a threadless bolt composed of a pin 171 and a head 172 (FIG. 6). The tips of the two fixing rods 17, 18 are fastened into the seat body 10. A first adjustment spring 42 is put around the pin 171 of one of the fixing rods 17, 18 and between the base 41 and the seat body 10 and a second adjustment spring 43 is put around the pin 171 of the fixing rod 17 and between the base 41 and the head 172. As a result, the power assist module 40 can be slid along the fixing rods 17, 18 by varying the lengths of the adjustment springs 42, 43. The power assist module 40 is of a pneumatic, hydraulic or pneudraulic type and has a central hole 44 to be passed through by the front portion 23 of the screwing rod 20 and/or the sleeve 26 for proving assistance to the screwing rod. The screwing rod 20 may be pressed by the power assist module 40 with a specific pressure or length.

As shown in FIG. 2, the anti-rotation mechanism 25 is composed of four retractable balls 251 on the front portion 23 of the screwing rod 20 and four longitudinal troughs 34 on the internal side of the screwing tube 30. The retractable balls 251 are separately received in cavities 24 on the front portion 23. The troughs 34 can be separately embedded by the retractable balls 251 to prevent the screwing rod 20 from rotating round the screwing tube 30 but to allow the screwing rod 20 to axially slide on the screwing tube 30. This makes the screwing rod 20 be synchronously rotated with the screwing tube 30 and telescope on the screwing tube 30.

Figure 4:
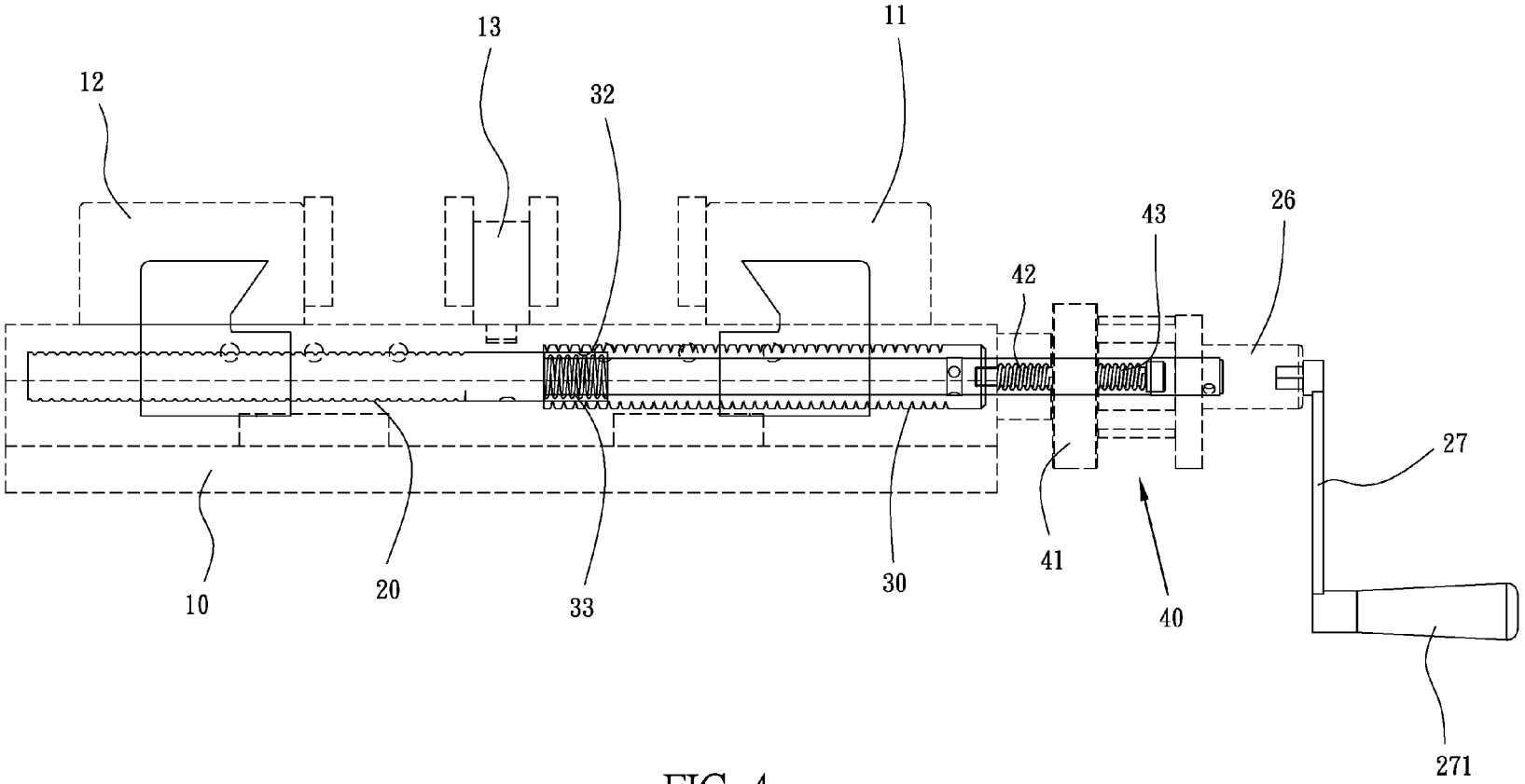
FIG. 4 is a schematic view of the invention.

As shown in FIG. 4, when the handle 271 is rotated to drive the screwing rod 20, the screwing tube 30 will be synchronously rotated by the screwing rod 20. Because the spiral directions of the first outer thread 211 and the second outer thread 31 are contrary, the two movable jaws 11, 12 will be moved oppositely. Thus two work pieces separately between the two movable jaws 11, 12 and the fixed jaw 13 can be clamped.

Figure 5:
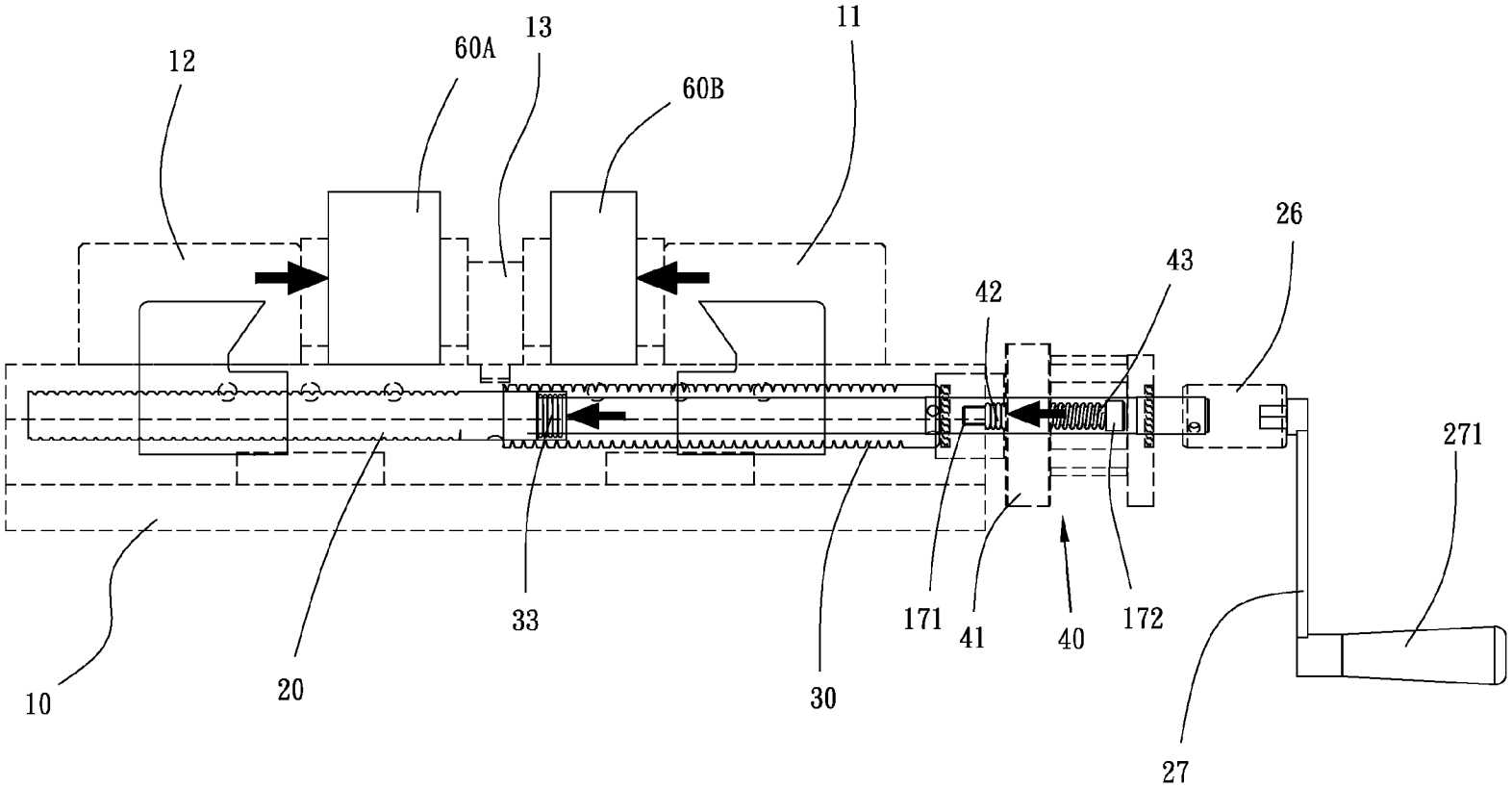
FIG. 5 is a schematic view showing the two clamps clamp two work pieces with different thickness.

As shown in FIGS. 5 and 6, when two work pieces 60A, 60B are different in thickness, size or shape, one of the movable jaws 11, 12, which clamps the thick work piece 60A or 60B, will stops to clamp it prior to the other one. At this time, keeping rotating the handle 271 will make the main spring 33 extended or compressed to vary an overall length of the screwing rod 20 and the screwing tube 30, and the power assist module 40 will also be pushed outwards or pulled inwards along the fixing rods 17, 18 by relative variations of the adjustment springs 42, 43 in length. Finally, the thin work piece 60A or 60B will be clamped later, and the clamping pressure to the two work pieces 60A, 60B with different thickness can keep equal. Furthermore, the power assist module 40 may be started to exert additional pressure onto the screwing rod 20 for adding or securing the clamping force.

Preferably, the rear portion 21 of the screwing rod 20 may be additionally provided with a limiting screw 281 penetrating a screw hole 28. The limiting screw 281 can prevent the screwing tube 30 from moving unduly rearwards. Thus the retractable balls 251 will not escape out of the screwing tube 30.

It will be appreciated by persons skilled in the art that the above embodiment has been described by way of example only and not in any limitative sense, and that various alterations and modifications are possible without departure from the scope of the invention as defined by the appended claims.

What is claimed is:

1. A double clamp vise comprising:

a seat body, having a rear movable jaw with a first inner thread, a front movable jaw with a second inner thread, a fixed jaw between the two movable jaws, and a rail for being slidably engaged by the two movable jaws;

a screwing rod, composed of a rear portion and a front portion, wherein a diameter of the rear portion is greater than that of the front portion, a first outer thread is formed on the rear portion, a step is formed between the front portion and the rear portion, the rear movable jaw is engaged with the screwing rod by screwing the first outer thread and the first inner thread;

a screwing tube, telescopically and unrotatably sheathing the front portion of the screwing rod, formed with a second outer thread, wherein the front movable jaw is engaged with the screwing tube by screwing the second outer thread and the second inner thread, a spiral direction of the first outer thread is contrary to that of the second outer thread, and a recess is formed in a rear end of the screwing tube;

a main spring, put around the front portion of the screwing rod and nipped between the step and an edge of the recess;

a crank with a handle, axially connected to the front portion of the screwing rod for rotating the screwing rod; and a power assist module, flexibly fixed on an end of the seat body, and passed through by the front portion of the screwing rod for proving assistance to the screwing rod;

wherein the power assist module has a base penetrated through by two fixing rods, each of the fixing rods is composed of a pin and a head, and tips of the two fixing rods are fastened into the seat body so that the power assist module can be slid along the fixing rods, a first adjustment spring is put around the pin of one of the fixing rods and between the base and the seat body, and a second adjustment spring is put around the pin with the first adjustment spring and between the base and the head.

2. The double clamp vise of claim 1, wherein an anti-rotation mechanism is arranged between the screwing tube and the front portion of the screwing rod.

3. The double clamp vise of claim 2, wherein the anti-rotation mechanism comprises at least one retractable ball on the front portion of the screwing rod and at least one longitudinal trough on an internal side of the screwing tube, and the at least one trough is embedded by the at least one retractable ball.

4. The double clamp vise of claim 1, wherein the power assist module is of a pneumatic, hydraulic or pneudraulic type.

5. The double clamp vise of claim 1, wherein the power assist module has a central hole to be passed through by the front portion of the screwing rod.

6. The double clamp vise of claim 1, wherein a sleeve with a through hole is disposed between the crank and the screwing rod.

7. The double clamp vise of claim 1, wherein the rear portion of the screwing rod is provided with a limiting screw for preventing the screwing tube from moving unduly rearwards.

* * * * *